US008028857B2

(12) United States Patent
Rasmussen

(10) Patent No.: US 8,028,857 B2
(45) Date of Patent: Oct. 4, 2011

(54) METHOD FOR DISPENSING A BEVERAGE AND DEVICES THEREFOR

(75) Inventor: Jan Nørager Rasmussen, Ølstykke (DK)

(73) Assignee: Carlsberg Breweries A/S, Copenhagen V ( * ) Notice: Subject to any disclaimer, the term of this patent is extended or adjusted under 35 U.S.C. 154(b) by 1469 days.

(21) Appl. No.: 10/555,226

(22) PCT Filed: May 6, 2004

(86) PCT No.: PCT/DK2004/000315

§ 371 (c)(1),
(2), (4) Date: Nov. 1, 2005

(87) PCT Pub. No.: WO2004/099060

PCT Pub. Date: Nov. 18, 2004

(65) Prior Publication Data

US 2006/0283879 A1 Dec. 21, 2006

(30) Foreign Application Priority Data

May 6, 2003 (DK) ..... 2003 00678

(51) Int. Cl.

| | |
|---|---|
| ***B67B 7/00*** | (2006.01) |
| ***B67D 1/00*** | (2006.01) |
| ***B67D 7/60*** | (2010.01) |
| ***B65D 35/56*** | (2006.01) |
| ***E03D 9/03*** | (2006.01) |

(52) U.S. Cl. ..... 222/1; 222/83; 222/105; 222/386.5; 222/389; 137/205.5

(58) Field of Classification Search ..... 222/81, 222/82, 83, 83.5, 88, 386.5, 389, 160, 162, 222/1, 105, 95, 96, 92, 93, 181.1, 185.1, 222/183, 186, 146.1, 146.6, 394, 399, 107, 222/94; 251/7; 137/205.5

See application file for complete search history.

(56) References Cited

U.S. PATENT DOCUMENTS

| | | | | |
|---|---|---|---|---|
| 3,166,096 | A * | 1/1965 | Lang | 137/564.5 |
| 3,380,628 | A * | 4/1968 | Cox, Jr. | 222/1 |
| 3,926,339 | A * | 12/1975 | Openchowski | 222/83 |
| 3,945,534 | A * | 3/1976 | Ady | 222/105 |
| 4,421,146 | A * | 12/1983 | Bond et al. | 141/349 |

(Continued)

FOREIGN PATENT DOCUMENTS

| | | |
|---|---|---|
| EP | 0377195 A1 | 7/1990 |
| EP | 0389191 A1 | 9/1990 |
| EP | 0579051 A2 | 1/1994 |

(Continued)

*Primary Examiner* — Kevin P Shaver
*Assistant Examiner* — Stephanie E Williams
(74) *Attorney, Agent, or Firm* — Fitch, Even, Tabin & Flannery

(57) ABSTRACT

A beverage dispensing assembly and a method for dispensing a beverage are provided in which a collapsible container provided with a base unit is mounted on a substantially flat base part of a dispensing assembly with the outlet of the container facing downwards. A free end of a dispensing tube is arranged at a closed dispensing tap located outside the dispensing assembly, and a hollow piercer connected to the dispensing tube is aligned with the outlet of the collapsible container. A cover is mounted on the base part in a hermetically sealed manner to form a pressure chamber between the collapsible container, the base unit, the base part and the cover. An increased pressure is provided in the pressure chamber, and the beverage is dispensed after the piercer has pierced the outlet of the container by opening the dispensing tap.

26 Claims, 9 Drawing Sheets

U.S. PATENT DOCUMENTS

Figure 1:
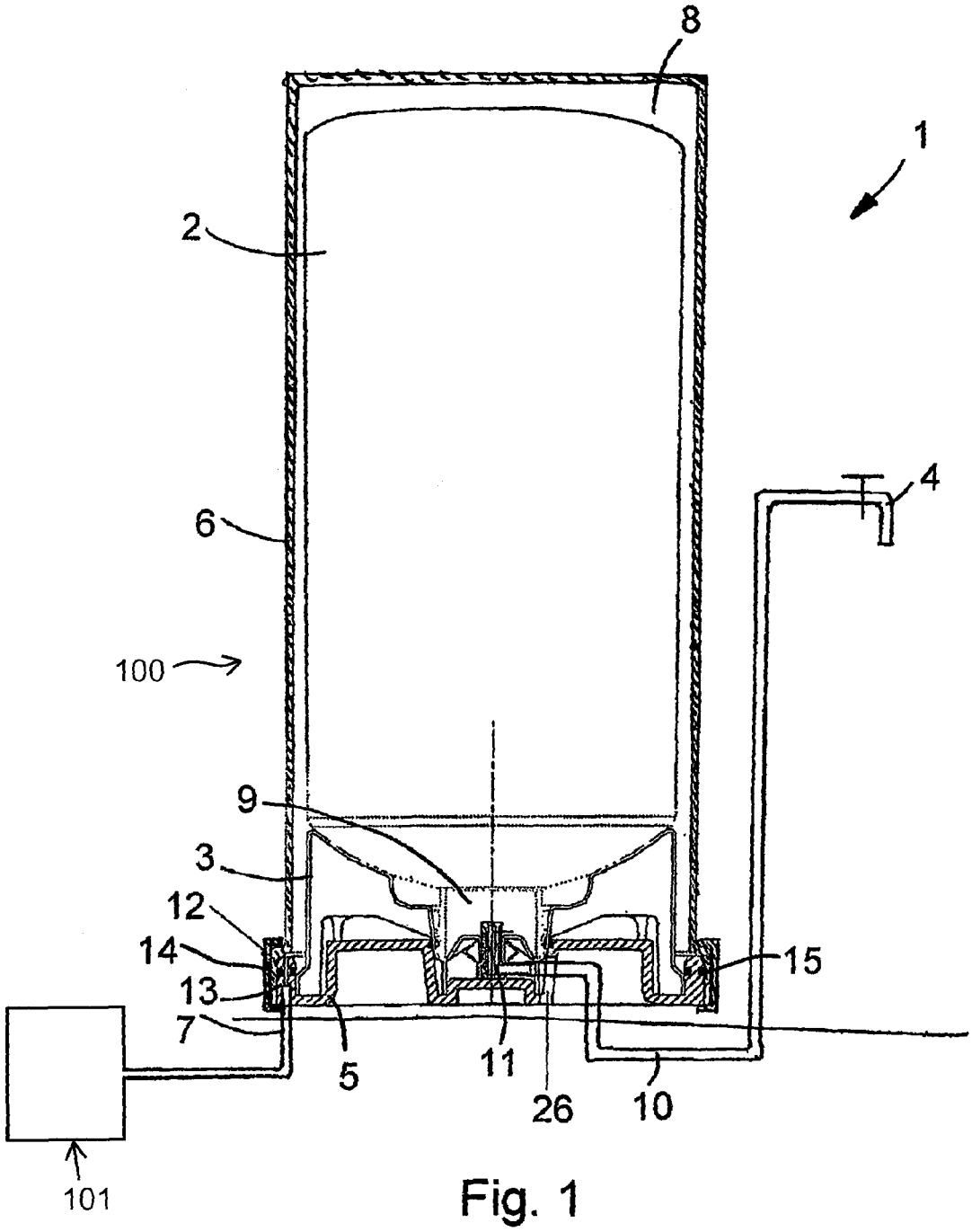

| | | | | | |
|---|---|---|---|---|---|
| 4,921,135 | A | * | 5/1990 | Pleet | 222/82 |
| 5,732,853 | A | * | 3/1998 | Ganzeboom et al. | 222/82 |
| 5,878,915 | A | | 3/1999 | Gordon et al. | |
| 6,082,584 | A | * | 7/2000 | Stern | 222/83 |
| 6,149,034 | A | * | 11/2000 | Amberg et al. | 222/82 |
| 6,155,457 | A | * | 12/2000 | Landa et al. | 222/94 |
| 6,253,808 | B1 | | 7/2001 | Amberg et al. | |
| 2002/0125271 | A1 | * | 9/2002 | Zeitlin | 222/181.3 |

FOREIGN PATENT DOCUMENTS

| | | | |
|---|---|---|---|
| EP | 1213258 | A2 | 6/2002 |
| GB | 2146705 | A | 4/1985 |
| GB | 2152019 | A | 7/1985 |
| NL | 1019526 | | 10/2001 |
| WO | WO 92/12926 | | 8/1992 |
| WO | WO 93/11059 | | 6/1993 |
| WO | WO 99/11563 | | 3/1999 |

* cited by examiner

METHOD FOR DISPENSING A BEVERAGE AND DEVICES THEREFOR

The present invention concerns a method for dispensing a beverage from a collapsible beverage container, a beverage dispensing assembly and a container unit adapted for use in such a beverage dispensing assembly.

Large-volume carbonated beverages, such as draught beer, are conventionally delivered to the place of consumption in metal kegs that typically hold a large volume of e.g. 25 liters. Such kegs are intended for expensive and elaborate dispensing assemblies comprising draught beer coolers, carbon dioxide cartridges, etc., for cooling and dispensing the beverage from the container. Such kegs and dispensing assemblies are well known in the art.

The metal kegs are heavy, and thus difficult to handle, and cause excessive transportation costs. Furthermore, metal kegs have high manufacturing costs, and need to be collected for refilling after complete or partial emptying. A keg is reused several times before it is scrapped. Consequently, kegs travel long distances in their lifetime and the heavier they are the higher the transportation cost. Additionally, the consumption of draught beer is very sensitive to seasonal variation. Especially in summer periods consumption is high, while in colder periods consumption is low. Therefore, to be able to meet the demand a large number of kegs must be in circulation causing storages of plenty of empty kegs during periods of low consumption.

Another disadvantage of the known draught beer assemblies is that many parts that are in contact with the beverage are reused and therefore require regular cleaning in order to keep the parts hygienically clean and to prevent bacteria growth. The cleaning is time consuming and it may be difficult to perform sufficiently thorough cleaning of all the parts. If the parts that are in contact with the beverage are not cleaned thoroughly it will influence the quality of the beverage.

To overcome some of these disadvantages beverage containers for dispensing assemblies produced in lighter, more flexible materials have been introduced. Plastics bags emptied by pressing out the content mechanically, pneumatically or hydraulically have been tested, but are too fragile for most practical purposes.

Also dispensing from collapsible beverage bottles made of plastics materials, e.g. PET, are known in the art. These bottles are emptied by collapse of the bottle wall by application of mechanical, pneumatic or hydraulic pressure causing the content to be squeezed out. Such beverage bottles contain only small volumes, such as a few liters, and are not directly comparable to metal kegs which hold a substantially larger volume of beverage. However, the collapsible bottles have a number of advantages over metal kegs in many aspects.

Plastics materials can be grinded up, and the resulting granulate can be used in production of new plastics materials. The granulate takes up little space, thus eliminating the need for large storages. Since the bottles are lighter they are easier to handle and involve smaller transportation costs. Plastics bottles can be made transparent to allow visual inspection of the content or they can be dyed in any desired colour. When emptied the bottle is collapsed and will take up little space during transportation for recycling.

A dispensing assembly with a collapsible beverage bottle is for example known from EP-A1-1 003 686. This apparatus constitutes an integrated dispensing device comprising a housing with a lid, sealing means, a pressure source, a cooling device and a dispensing tap.

The housing of the assembly is adapted for receiving a collapsible beverage container in the shape of a bottle. This bottle is provided with a collar, mounted on the neck and shoulder part of the bottle, providing a flange that extends beyond the cylindrical wall part of the bottle in a radial direction at the shoulder of the bottle. The flange is provided with means for cooperating with sealing means on a rosette arranged at the top of the box-shaped housing part. This rosette has a series of segments arranged in a circle around the periphery of the top opening of the housing. Each segment is provided with a spring, allowing the tap to be moved in a radial direction. When the bottle is installed the flange on the bottle rests against the upper surface of the segments of the rosette, and manipulations with the outlet opening can be performed in this phase. Then the container is pushed down spreading the segments of the rosette and falling to the bottom of the housing. The radial extension of the flange of the bottle is adapted to make a sealing with the inner wall of the housing at the lower surface of the rosette, thus creating a pressure chamber between the inner wall of the housing, the cylindrical wall part of the bottle, and the flange on the shoulder of the bottle. When the lid is closed a pressure medium is introduced into the housing. The raising pressure in the pressure chamber will force the bottle upwards in the direction of the lower pressure of the surroundings, until the upper part of the flange of the bottle abuts on the lower surface of the rosette. The beverage is now under pressure, and can be forced out by the reduction of the volume of the bottle by leading the content through a conduit to a dispensing tap integrated in the apparatus.

However this solution has a number of unfortunate disadvantages.

The dispensing apparatus has a complicated design, comprising a vast number of parts, the parts themselves being elaborate, costly devices. For example the rosette has a large number of cooperating parts and springs for each radially displaceable segment, and a special release mechanism to spread the segments when the bottle needs to be replaced.

Once the bottle has been pierced the outlet cannot be closed or sealed off to prevent the content from being spilled when a not completely empty bottle is removed from the housing. Such situations could arise when the bottle is to be replaced by a new bottle or in case of breakdown or maintenance of parts of the apparatus. Also, in places with only little consumption e.g. bars or restaurants in remote locations, it may be necessary to discard some quantities of beverages due to its limited durability.

In a hectic work environment, e.g. a bar or restaurant, the need for a reliable dispensing apparatus is crucial. It is important that the staff handling the dispensing assembly can anticipate when the bottle needs to be replaced. Also, in case of problems with the apparatus there is a need to be able to quickly identify the problem. The bottle of the known assembly is placed in an insulated box-shaped housing adapted for containing cooling and pressurizing devices as well. Such housing does not allow visual inspection of the parts of the assembly or of the content of the bottle.

Due to e.g. government regulations, environmental concerns, and material costs it is desired to recycle the bottle when it is emptied. This is often done by collecting and grinding the plastics material bottles. However, this process would be complicated if the container has a residual content. Either such reside has to be removed, washed out, or the bottle has to be discarded permanently. Since collapsible plastics bottles are collapsed it is difficult or impossible to clean out any residual content. The residual content of the collapsed bottle should therefore be minimized. Obviously a residual content also represents a vast, and thus a loss for the user of the apparatus. When, in the known dispensing apparatus, the bottle is collapsed fairly, large quantities of beverage will be trapped in pockets cut off by folds of the collapsing bottle.

The bottom of the collapsible beverage bottle of the known dispensing assembly has to be adapted to serve as a standing surface for the bottle during handling and in the housing of the dispensing assembly. Consequently, the bottom has to be shaped and/or reinforced in a manner that inhibits optimal collapsing of the bottom part of the bottle, and thus allowing the formation cut-off pockets in the collapsed bottle, where residual beverage can be trapped.

In the known device the beverage needs to be elevated from the bottom of the beverage bottle to the outlet at the top of the bottle to be dispensed through the dispensing tap. This requires a large pressure. The larger the pressure needed, the higher the requirements to the pressurizing source, and the higher become the costs of the pressurizing source.

It is the object of the present invention to provide a method for dispensing a beverage, a dispensing assembly and a container for use in such a dispensing assembly that in volume and applicability are comparable to those applying to large-volume metal kegs and that overcome the disadvantages of the prior art beverage dispensing apparatus employing a collapsible bottle.

The invention concerns a method for dispensing a beverage from a collapsible container, which method comprises the steps of:

- mounting the collapsible container provided with a base unit that seals an outlet of the collapsible container on a substantially flat base part of a dispensing assembly with the outlet of the container facing downwards, said base unit and said base part being provided with sealing means for hermetically sealing the base unit to the base part;
- arranging a free end of a dispensing tube at a closed dispensing tap located outside the dispensing assembly, said dispensing tube being connected to a hollow piercer that is aligned with the sealed outlet of the collapsible container;
- mounting a cover on the base part in a hermetically sealed manner to form a pressure chamber between the collapsible container, the base unit, the base part and the cover;
- piercing the sealed outlet of the collapsible container by the hollow piercer arranged between the sealed outlet and the base part, thereby bringing the beverage in the collapsible container in communication with the dispensing tube;
- providing an increased pressure in the pressure chamber;
- opening the dispensing tap to dispense at least a part of the beverage through the dispensing tube to the environment by pressurizing the collapsible container and thereby reducing the volume thereof.

By providing the method for dispensing a beverage from a collapsible container in this manner, some of the problems related to the prior art are overcome. In particular, by placing the collapsible container in the pressure chamber with the outlet of the container facing downwards a number of advantages are achieved.

The up-side down arrangement of the collapsible container aids the emptying of the container in the pressure chamber. No pockets of entrapped beverage occur when the container is collapsed. Only droplets may remain in the container, and it can therefore be considered fully emptied.

The mounting of the container unit on a substantially flat base part simplifies the installation process considerably, since the container need not be manoeuvred over the walls of the dispensing assembly as is the case with the prior art assemblies. Thereby the structure allows for easy placement of even large beverage containers.

A further consequence of the up-side down orientation of the container is that the pressure required for emptying the collapsible container is reduced, thus allowing a choice of lighter materials for the component parts of the dispensing assembly. Furthermore the dispensing assembly can be pressurized utilizing a simple, inexpensive, low capacity air pump or even with water from an ordinary household or garden tap.

A general problem with mounting containers with the outlet end facing downwards is that the opening and closing of the container is difficult without risking that the content will be spilled. With the method according to the invention these difficulties are overcome, since the dispensing assembly comprises a hollow piercer that is connected to a dispensing tube. Thus the dispensing tube can be connected to a dispensing tap, even when the container is oriented with the outlet facing down, as long as the hollow piercer has not yet pierced the sealed outlet of the container.

In a preferred embodiment the container provided with the base unit is temporarily kept apart from the base part by means of resilient means until an increased downwards force is applied to the container whereby the container moves downwards causing the piercer to pierce the sealed outlet. This allows time to place the cover over the container before the outlet of the container is pierced. It also allows access to the outlet and time to place the dispensing tube at the closed dispensing tap when the container unit is placed on the base part, if this has not been done before the container with the base unit was mounted on the base part. Subsequently the container can be opened by the piercer piercing the seal on the outlet of the container by forcing the container downwards overcoming the resilience of the resilient support means. The increased downwards force can be applied manually or by increasing the pressure in the pressure chamber.

In a preferred embodiment the free end of the dispensing tube is manoeuvred to the dispensing tap outside the dispensing assembly through an opening in the base part before the piercer pierces the sealed outlet. Thereby is achieved that the dispensing tube is not pressurised and handling thereof is facilitated.

Preferably the base unit is provided with a seal that aseptically seals the sealed outlet, and this seal is removed before the container provided with the base unit is mounted on the base part. Providing the base unit with a seal ensures that all parts in the base unit are kept aseptically clean right until the container is installed in the dispensing assembly.

The invention further concerns a beverage dispensing assembly suitable for performing the method for dispensing a beverage from a collapsible beverage container comprising:

- a collapsible beverage container comprising
  - a generally cylindrical, collapsible wall part,
  - an outlet end,
  - a neck part at the outlet end;
- a pressurizing unit comprising
  - means for connecting the pressurizing unit to a pressure media source,
  - a substantially flat base part,
  - a cover, said base part and cover being sealingly interconnectable;
- a base unit comprising
  - a housing,
  - a piercable closure for sealing the collapsible container,
  - locking means for inseparably and hermetically connecting the base unit to the neck part of the collapsible container, sealing means for hermetically sealing the collapsible container to the base part;

a hollow piercer adapted for piercing the piercable closure;

a closable dispensing tube connected to the hollow piercer;

where the base unit and the neck part are provided at a lower end of the container, and where said housing of the base unit has an outer wall extending axially beyond said neck part in a downwards direction substantially in extension of the wall of the collapsible container, and where said base part has a surface adapted for supporting said outer wall extension.

The latter structure of the base unit adapted for cooperation with the base part, allows the container unit consisting of the container and the base unit to stand upright with the outlet of the container facing downwards. The base unit allows the container unit to stand on the base part as well as on any other surface without any risk of damaging the outlet of the container, since the outer wall of the base unit extends beyond the neck part of the container. Additionally, this leaves the upper end of the generally cylindrical collapsible container opposing the outlet end to be shaped in a manner for optimal collapsing performance.

The substantially flat base part simplifies the installation of the container considerably, since the container need not be manoeuvred over the walls of the dispensing assembly as is the case with the prior art assemblies. Thereby the structure allows for easy placement of even large beverage containers.

In the beverage dispensing assembly of the present invention the cover extends vertically from the substantially flat base part over the collapsible container, contrary to prior art dispensing assemblies in which a pressure chamber is provided in a box-shaped housing with a lid. The cover of the present invention can be manufactured in a light material, such as plastics, which is inexpensive and easy to handle. Furthermore, this allows the cover to be made transparent allowing for visual inspection of the content of the container, provided the container is also transparent.

Since the base unit is provided with means for sealingly connecting the container with the base unit to the base part, a pressure chamber is simply created by placing the container unit on the base part and placing the cover over the container unit and sealing it to base part. Also, the container unit is easily dismounted by simply reversing the process.

In a preferred embodiment the sealing means for hermetically sealing the collapsible container unit to the base part is provided as between a collar on the base unit and the base part, the collar extending downwards from, and substantially in axial extension of, the neck part of the container. Thus the pressure chamber can be formed by simply placing the container unit on the base part and closing the cover. In an alternative embodiment, or additionally, the sealing means for hermetically sealing the collapsible container to the base part is provided between the outer wall of the base unit and base part.

In a further embodiment the dispensing assembly is provided with resilient support means for temporarily spacing the container and base unit from the base part. This prevents opening of the container by the piercer until a downwards pressure is applied to the container unit. In this way unintentional opening of the container is prevented. Also this allows time for manipulating the outlet end of the container if this should be necessary, e.g. for placing a dispensing tube. In a preferred embodiment the resilient support means are provided in the base unit extending axially downwards therefrom, but the resilient support means could be provided on the base part as well.

In a preferred embodiment the hollow piercer arranged between the base unit and the base part and aligned with the sealed outlet of the collapsible container is provided in the base unit. In this way the piercer can be protected from accidental impacts that could for example occur during the mounting of the container unit on the base part. Arranging the piercer in the base unit also means that a new piercer is delivered integrally with each new container unit to minimize or possibly eliminate the number of reusable parts that need to be cleaned before use.

Preferably the hollow piercer has means for abutment on the base part, while the base part has corresponding abutment means. This allows the piercer to open the container by piercing the sealed outlet automatically when the container unit is forced downwards towards the base part, since the abutment with the base part forces the piercer to move relative to the base unit. The need to manually handle the opening of the container before placing the container unit in the dispensing assembly is thus avoided.

In a preferred embodiment resilient means are provided between the hollow piercer and the base unit, said resilient means providing means for closing the container if the container has to be removed from the base part. This allows the piercer to function as a valve, closing the container automatically when the container unit is dismounted from the base part. The container unit can thus be removed temporarily or permanently without being completely emptied, e.g. in case of repair or adjustment of the dispensing assembly.

In another embodiment the hollow piercer aligned with the sealed outlet of the collapsible container is provided on the base part.

In another embodiment of the beverage dispensing assembly the base unit comprises a resilient cup-shaped part, said cup-shaped part comprising a side wall, a bottom adapted for cooperating with a central elevation on the base part, and a hollow piercer the base unit further comprising a closure formed on an upper rim of the cup-shaped part.

In another embodiment the piercer is arranged asymmetrically with respect to a central axis through the base unit.

In yet another embodiment the base unit has an annular space for accommodating the dispensing tube. Thereby a new aseptic dispensing tube for connecting the container unit to the dispensing tap can be delivered with each container unit, which ensures a minimal number of reusable parts and thereby minimises the risk of contamination. Preferably the free end of the dispensing tube is provided with a dispensing valve as well. This dispensing valve can be adapted for a dispensing tap. In this way no reusable parts of the dispensing assembly has to be in contact with the beverage. All parts having contact with the beverage are thus for single use only.

The invention also concerns a container unit comprising a collapsible container and a base unit adapted for a dispensing assembly as stated above, wherein said base unit seals a downwardly facing neck part comprising an outlet of the collapsible container, the base unit comprising an outer wall extending axially beyond said neck part in a downwards direction substantially in extension of the wall of the collapsible container, and where a removable aseptic seal covering the outlet is provided. The aseptic seal protects the outlet of the container unit from contamination during transportation, and is intended for removal before mounting of the container unit on the base part.

Preferably the removable aseptic seal is connected to the outer wall at the bottom of the base unit. In this way the removable aseptic seal closes the above mentioned annular space provided in the bottom part of said container unit providing an aseptic room where aseptic parts for the dispensing assembly, such as the hollow piercer and the dispensing tube, can be stored during the transportation of the container unit.

This allows for delivery of a complete tamperproof aseptic set needed for dispensing a beverage, the set comprising all parts that need be in contact with the beverage.

Figure 2A:
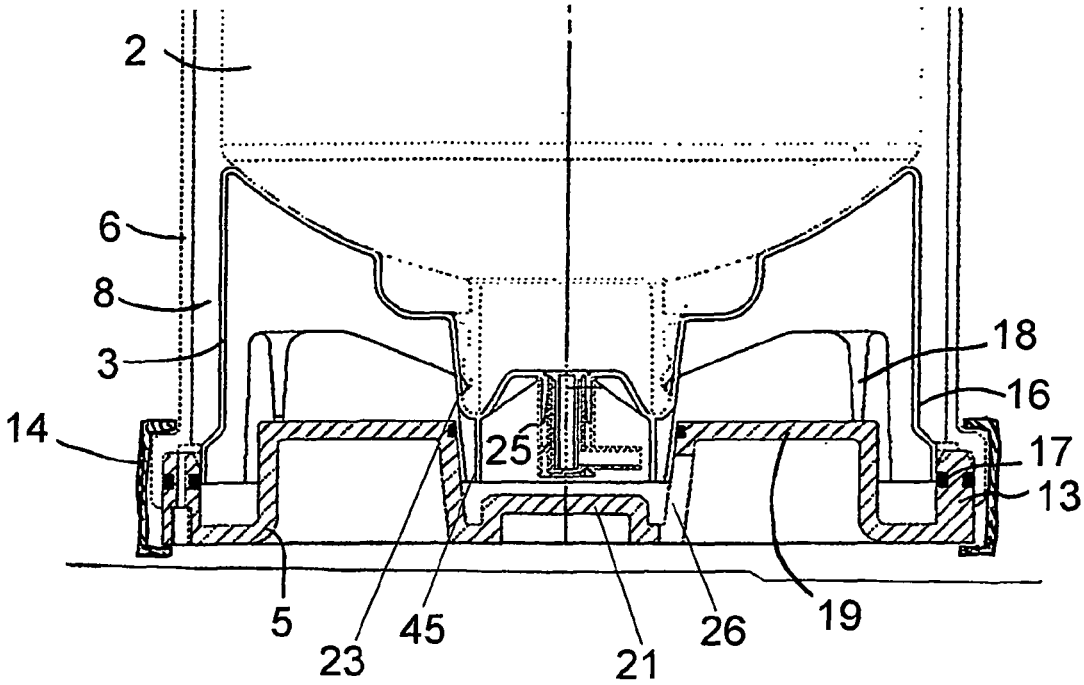
Figure 2B:
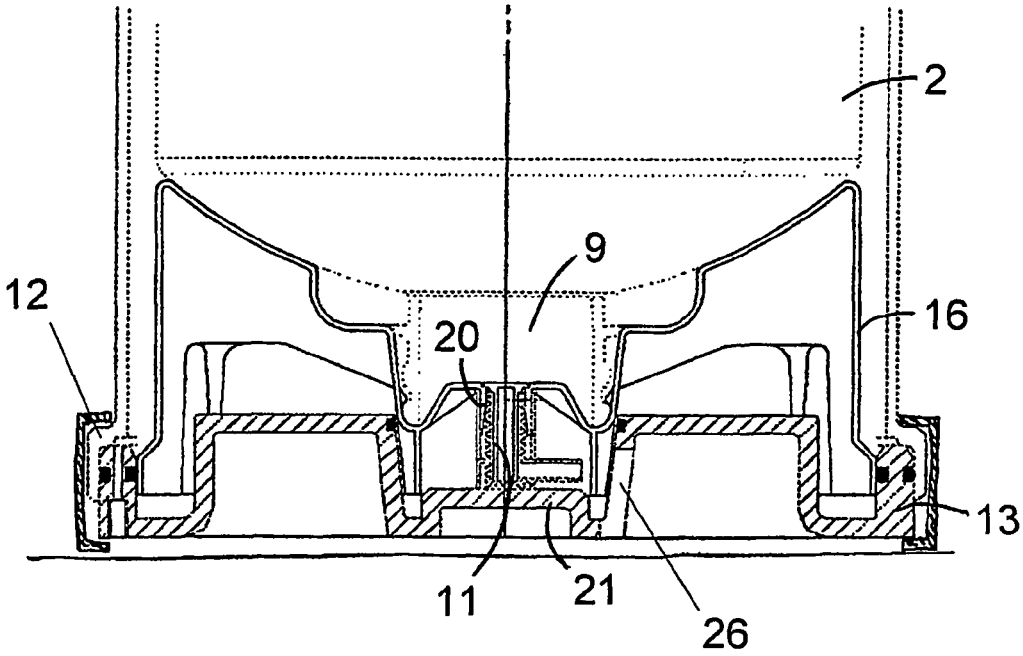
Figure 2C:
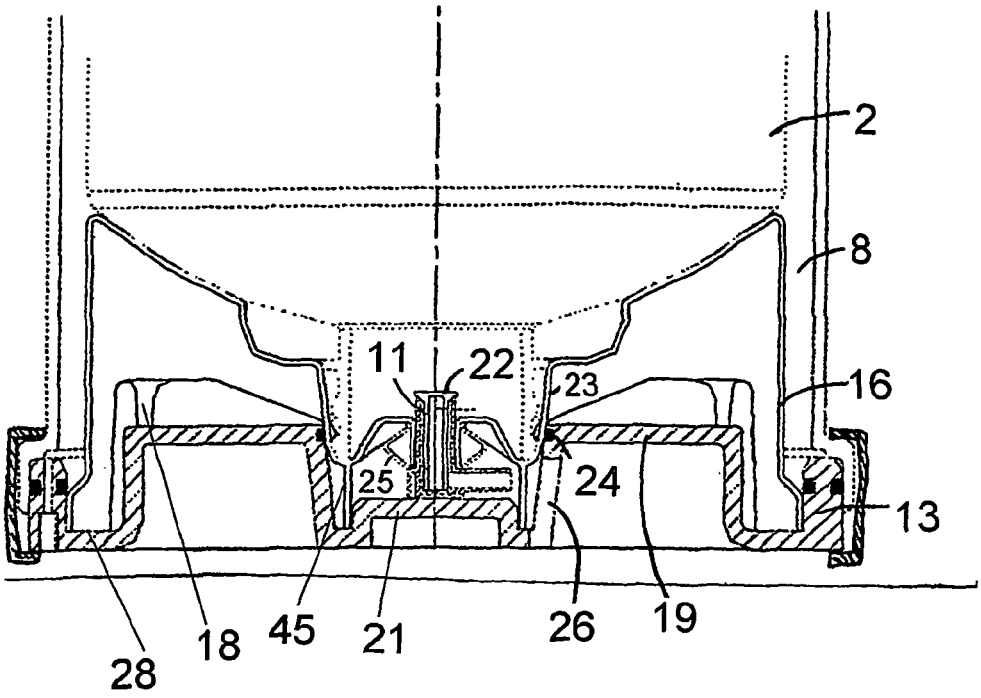
Figure 3:
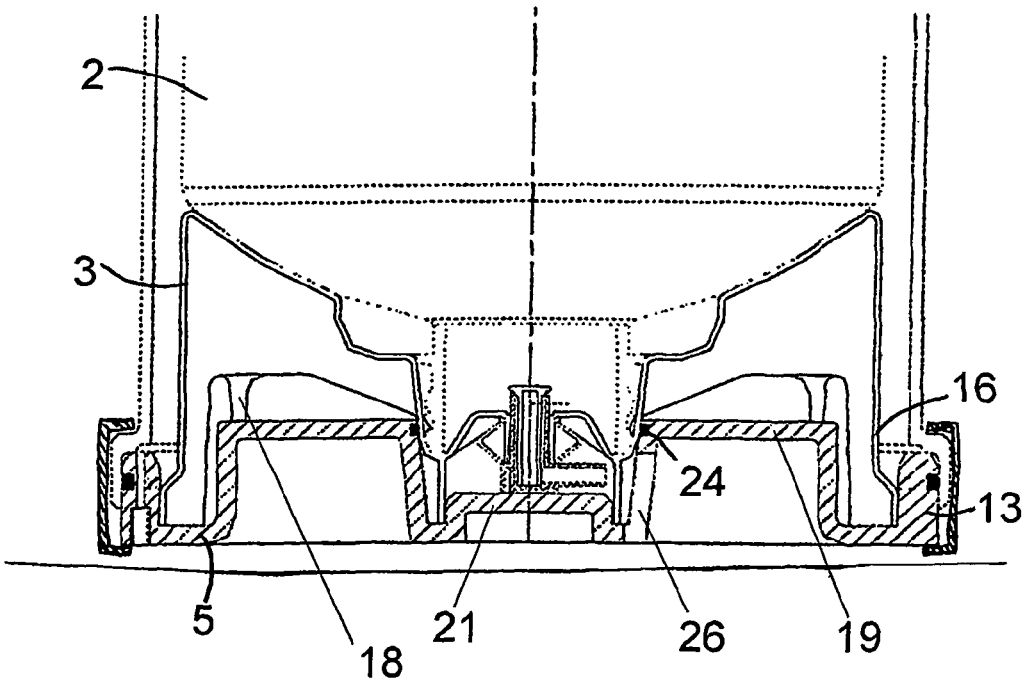
Figure 4:
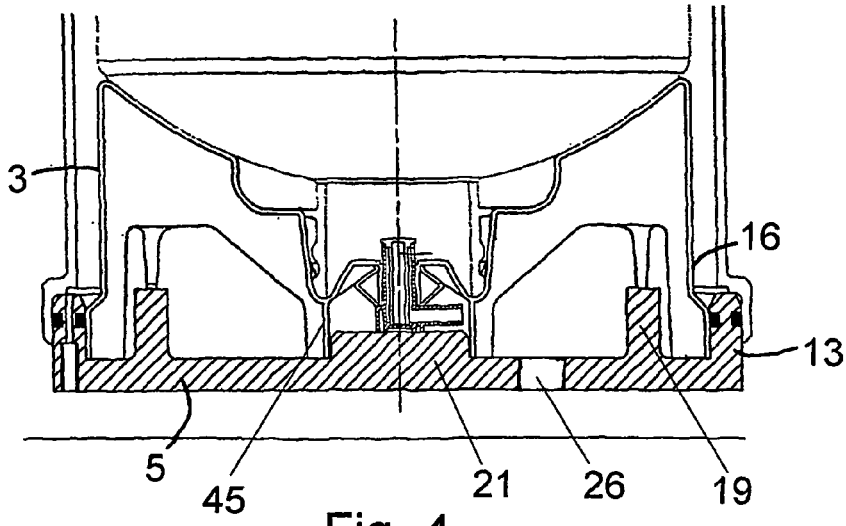
Figure 5A:
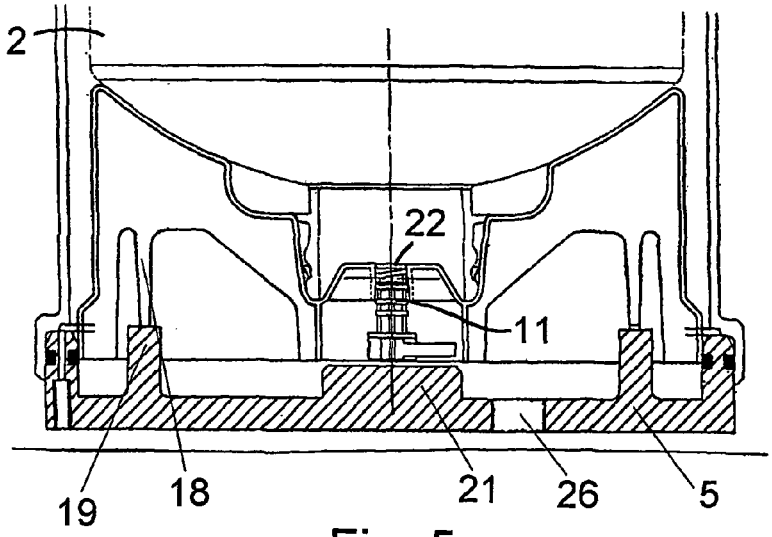
Figure 5B:
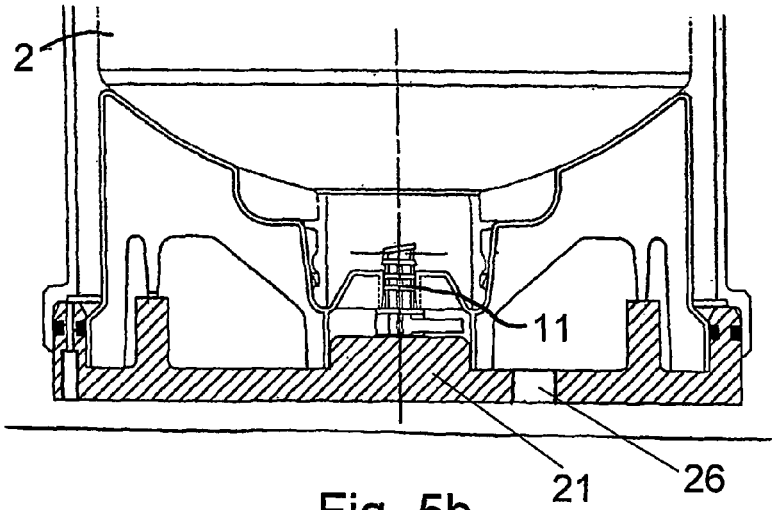
Figure 6A:
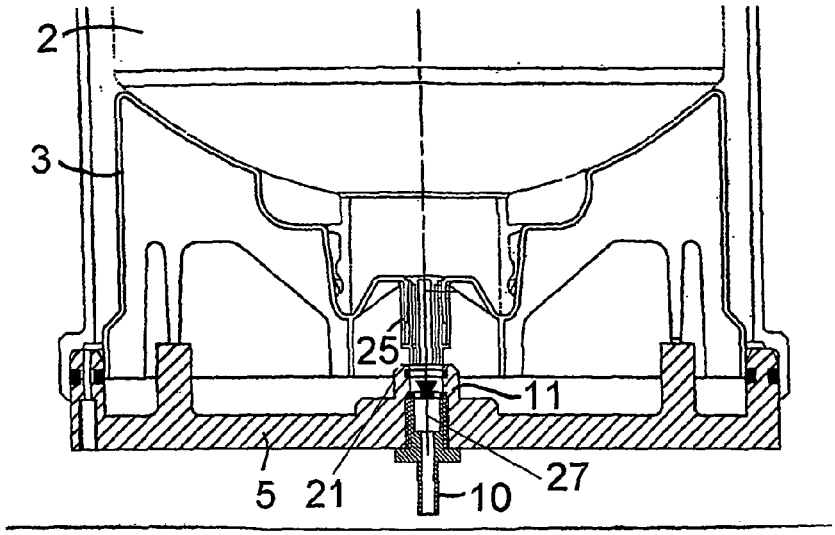
Figure 6B:
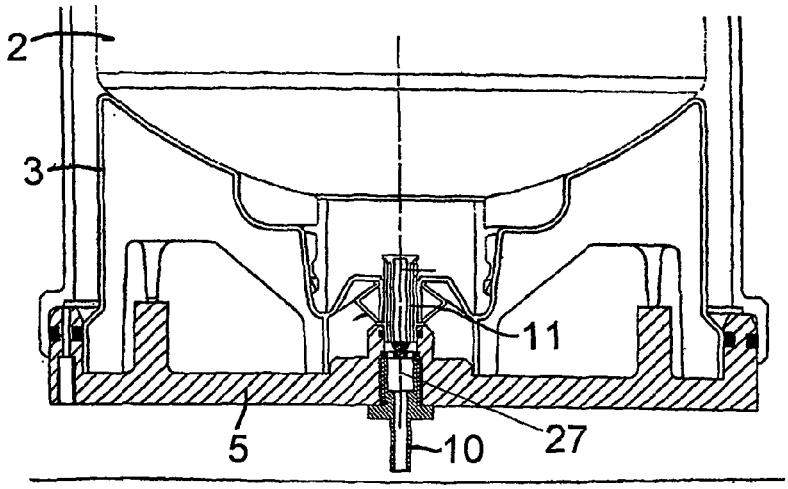
Figure 7A:
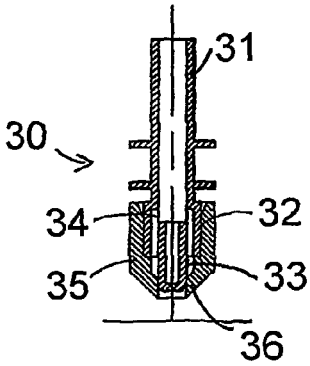
Figure 7B:
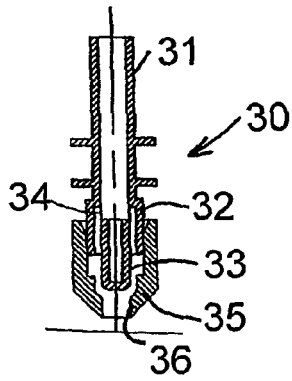
Figure 8A:
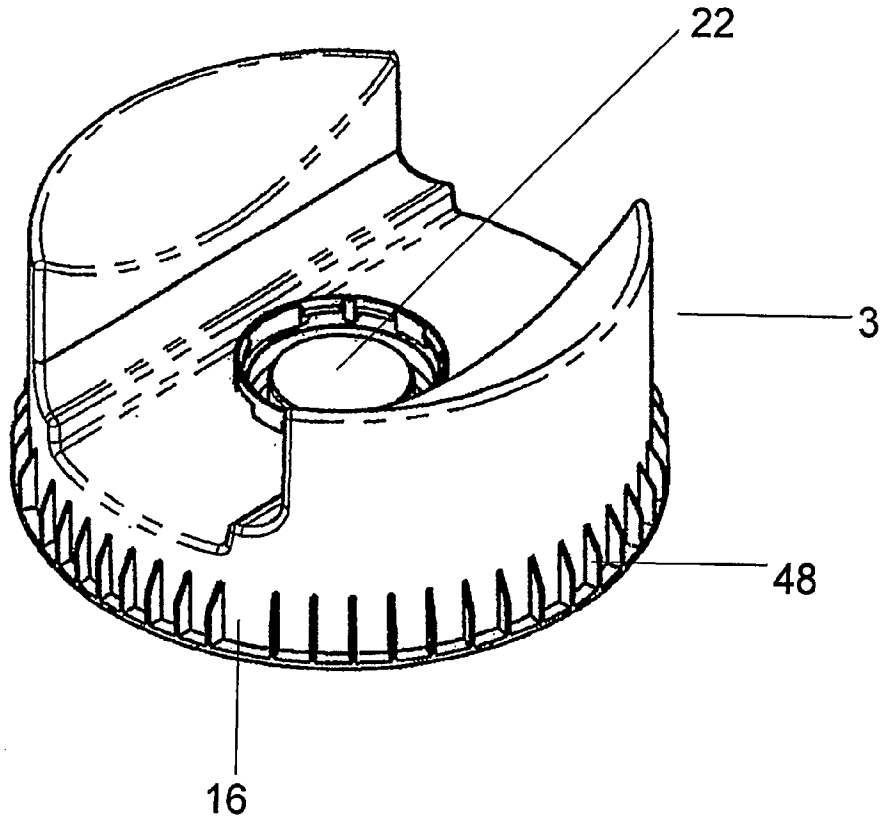
Figure 8B:
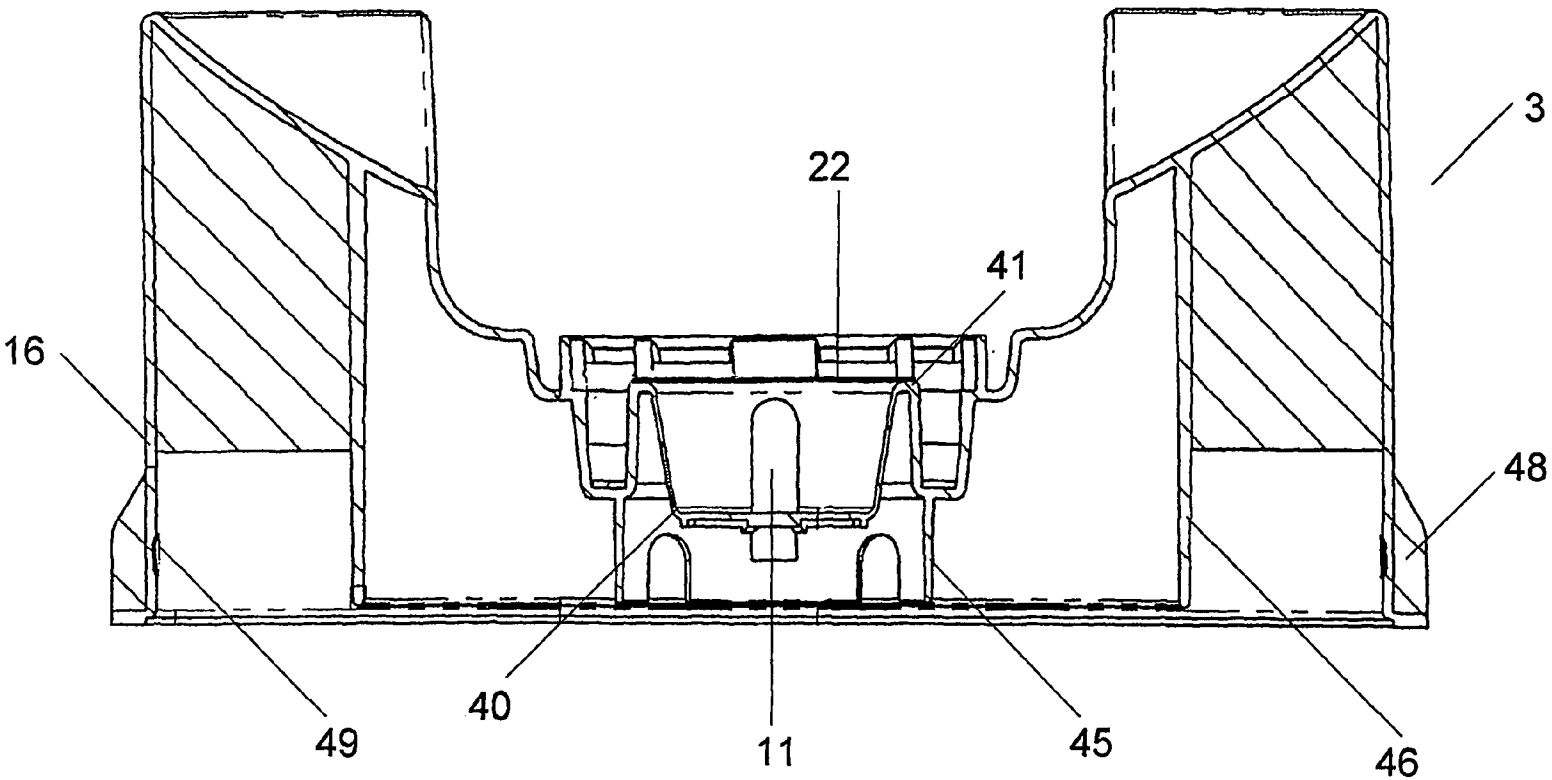
Figure 8C:
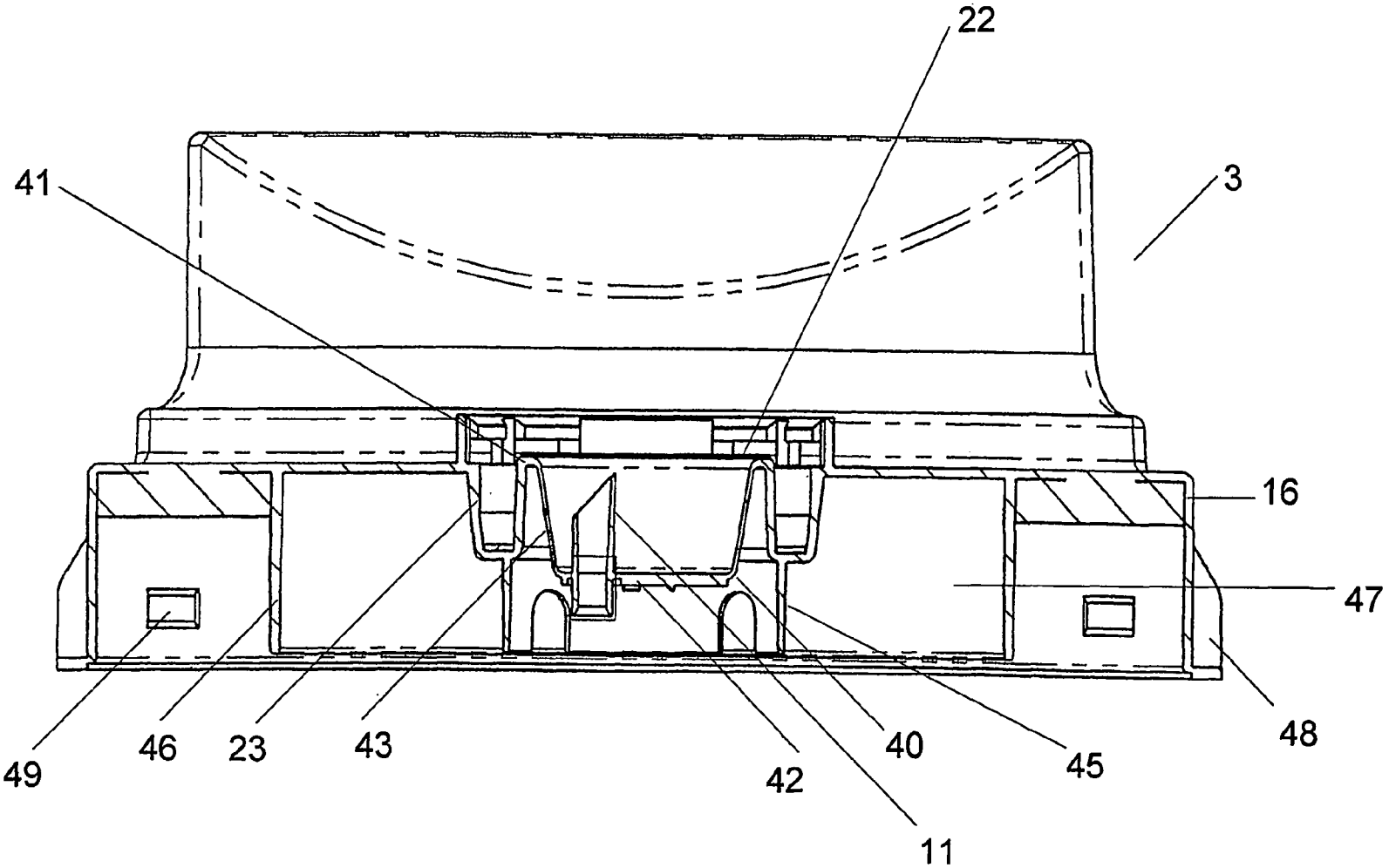
Figure 8D:
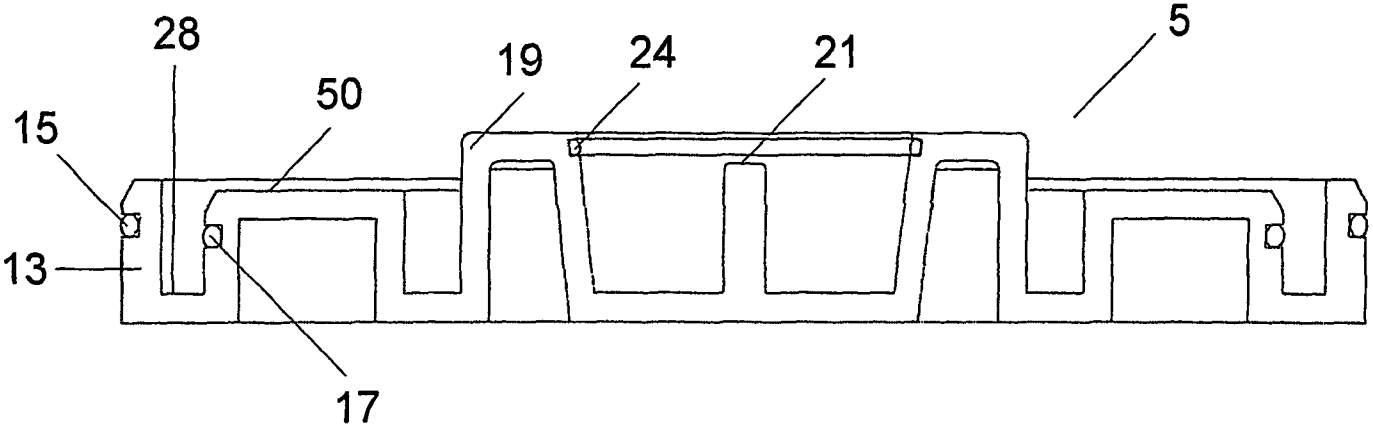

In the following the present invention will be described in detail with reference to the figures, in which FIG. 1 schematically depicts a sectional view of a beverage dispensing assembly according to the invention including a collapsible beverage container with a base unit mounted in a pressure chamber;

FIGS. 2*a*-2*c* in sectional views show details of a first embodiment of a beverage dispensing assembly according to the invention;

FIG. 3 in sectional view shows details of a second embodiment of a beverage dispensing assembly according to the invention;

FIG. 4 in sectional view shows details of a third embodiment of a beverage dispensing assembly according to the invention;

FIGS. 5*a* and 5*b* in sectional views show details of a fourth embodiment of a beverage dispensing assembly according to the invention;

FIGS. 6*a* and 6*b* in sectional views show details of a fifth embodiment of a beverage dispensing assembly according to the invention;

FIGS. 7*a* and 7*b* show a dispensing valve for the dispensing assembly according to the invention; and FIGS. 8*a*-*d* show details of an alternative embodiment of a beverage dispensing assembly according to the invention, where FIG. 8*a* shows a base unit in a perspective view, FIGS. 8*b* and 8*c* show partial sectional views taken through different sections of FIG. 8*a*, and FIG. 8*d* shows a sectional view through a base part adapted for cooperation with the base unit shown in FIGS. 8*a*-*c*.

A dispensing assembly 1 for dispensing a beverage from a collapsible container 2 is shown in FIG. 1. The dispensing assembly 1 comprises a collapsible beverage container 2 with a base unit 3 placed in a pressurizing unit of the dispensing assembly 1 for dispensing the content of the container for consumption through a dispensing tap 4 shown schematically. The pressurizing unit 100 comprises a base part 5, a cover 6 and a pressure fluid inlet 7 in communication with the pressure chamber 8 constituted by the space between the base part 5, the cover 6, the container 2 and the base unit 3. The pressure fluid inlet 7, extending through a side wall, i.e. peripheral part 13, of the base part 5, is in communication with a pressure source 101, e.g., pressure media source, e.g., the carbon dioxide cartridge of a conventional draught beer dispensing assembly, a small air pump or simply tap water. Thus the pressurizing fluid may be a liquid or a gas, whichever is available.

For installation the cover 6 is separated from the base part 5, and the collapsible beverage container 2 with a base unit 3 is mounted on the base part 5 with the outlet 9 of the container 2 facing substantially downwards and at least facing the base part 5. The free end of a dispensing tube 10 connected to a piercer 11 aligned with the outlet 9 is connected to the dispensing tap 4. When the container 2 has been mounted on the base part 5, the cover 6 is connected to the base part 5 in airtight connection, encapsulating the collapsible container 2, and pressure is applied through the pressure fluid inlet 7. The lower end of the cover 6 is provided with a flange 12 that fits around an upwardly extending peripheral part 13 of the base part 5, and the cover 6 and the base part 5 are secured to each other by means of an annular, U-shaped locking ring 14. Alternatively other suitable coupling means such as e.g. a bayonet coupling or threaded parts can be utilized for securing the cover 6 to the base part 5. Sealing means, e.g. an O-ring 15 cooperating with the flange 12 is provided between the peripheral part 13 of the base part 5 and the flange 12 in order to ensure an airtight interconnection between the two parts.

FIG. 1 shows the beverage dispensing assembly 1 in the ready-to-use state, i.e. in a state where the outlet 9 or the container 2 has been pierced and the beverage is in communication with the dispensing tap 4 via the dispensing tube 10. In this situation the pressure in the pressure chamber 8 has a desired high level, and when the dispensing tap is opened the beverage is forced through the dispensing tube 10 while the container 2 collapses (not shown). When the container is empty, and therefore fully collapsed, the locking ring 14 is released and the cover 6 can be removed from the base part 5. Then the collapsed container 2 can be replaced by a new full container 2.

The installation process will be described in further detail in the following with reference to FIGS. 2*a*-2*c* that show a first embodiment of a beverage dispensing assembly according to the invention.

FIG. 2*a* shows the situation where the container 2 has been placed on the base part 5 and the cover 6 is mounted and secured to the base part by means of the locking ring 14 as described above. No pressure has yet been applied to the pressure chamber 8. In this situation the outer wall 16 of the base unit 3 is in sealing interconnection with the peripheral part 13 of the base part 5, e.g. by means of an O-ring 17 or other suitable sealing means arranged between the base part 5 and the base unit 3.

The base unit 3 may be provided with resilience means in the shape of three or more taps 18 that extend downwardly in the base unit 3. The taps 18 abut on an elevated annular platform 19 in the base part 5 and are sufficiently strong to support a full container 2 as long as no substantial downwardly extending force is applied to the container 2. However, when the pressure in the pressure chamber 8 is increased, the container 2 with the base unit 3 experiences a downwardly directed force due to the different pressures prevailing within and outside the pressure chamber 8. When the pressure differential reaches a certain level, the taps 18 are no longer able to resist the downwardly directed force and they bend or break causing the container 2 and the base unit 3 to move downwards.

An intermediary position is shown in FIG. 2*b* where the container 2 and the base unit 3 have moved a distance downwards. The outer wall 16 is still in sealing contact with the peripheral part 13 of the base part 5. In the shown position the piercer 11, which will be described in more details below, and which is aligned with the outlet 9 of the container and in slideable relation to a support wall 20 of the base unit, abuts on a central elevation 21 of the base part 5.

In the final position shown in FIG. 2*c* the piercer 11 has pierced the closure 22 of the outlet 9 of the container 2. Thus, the piercing of the container closure 22 is conducted automatically when pressure is applied to the pressure chamber 8.

In this position further downward movement of the base unit 3 and the collapsible container 2 is impeded by the lower periphery of the outer wall 16 of the housing of the base unit 3 abutting on a surface 28 on base part 5. Thus the collapsible container 2 with the base unit 3 is supported on the base part 5.

FIG. 2*c* shows that the outer wall 16 is no longer in sealing contact with the peripheral part 13 of the base part 5. The pressure chamber 8 is now limited by a sealing between the base part 5 and the base unit 3 at a collar 23 on the base unit extending downwards from, and substantially in axial extension of, a neck part of the container 2 and an inwardly facing surface of the elevated annular platform 19. Sealing means e.g. an O-ring 24 is arranged to ensure the hermetically sealing engagement, between the base part 5 and the base unit 3.

The piercer 11 in the embodiment shown in FIGS. 2*a*-2*c* is made as an integrated part of the base unit 3. The piercer 11 is provided with a collar 25 extending from the lower abutment part towards the collapsible beverage container 2 on the outside of the support wall 20. The collar 25 is provided with one or more slits (not shown) and is preferably constructed in the same material as the other parts of the piercer 11. The slits of the collar 25 provide resiliency to the collar 25, and causes the collar 25 to flex outwards, when the piercer 11 is forced towards the container 2 to pierce the closure 22 at a weak section as shown in FIG. 2*c*.

The resilient collar 25 will cause the piercer 11 to move back to its original position and thereby close the collapsible beverage container 2, if the container 2 is lifted away from the base part 5. In this embodiment the piercer 11 functions as a self-closing valve. This is advantageous in case the container has to be removed before it is completely emptied. Due to the self-closing mechanism the container 2 does not need to be emptied completely through the dispensing tap 4 before removal as it would be the case if no mechanism was provided.

The base part 5 is provided with an opening 26 through which the dispensing tube 10 (see FIG. 1) can be manoeuvred before the container 2 with the base unit is positioned on the base part 5.

FIG. 3 shows in sectional view details of a second embodiment of a beverage dispensing assembly according to the invention. For easy reference the same reference numerals will be used for the same parts as those in FIGS. 1-2*c*, even though small differences may occur.

The second embodiment shown in FIG. 3 differs from the first embodiment shown in FIGS. 1-2*c* in that the sealing between the outer wall 16 of the base unit 3 and the upwardly extending peripheral part 13 of the base part 5 has been dispensed with. The taps 18 for initially supporting the container 2 with the base unit 3 on the base part 5 are still present, and due to the lack of sealing engagement between the base unit 3 and the base part 5, no pressure chamber can initially be created. It is therefore necessary to manually apply a downwardly directed force to the container 2 with the base unit 3 until the position shown in FIG. 3 is reached with a sealing contact between the base unit 3 and the base part 5 by means of e.g. the O-ring 24.

FIG. 4 shows in sectional view details of a third embodiment of a beverage dispensing assembly according to the invention. Again, the same reference numerals will be used for the same parts as those in FIGS. 1-2*c*, even though small differences may occur.

In this third embodiment the sealing engagement between the base part 5 and the base unit 3 is provided only between the outer wall 16 of the base unit and the upwardly extending peripheral part 13 of the base part 5. The configurations of the base unit 3 and the base part 5 are modified accordingly.

FIGS. 5*a* and 5*b* show in sectional views details of a fourth embodiment of a beverage dispensing assembly according to the invention. Again, the same reference numerals will be used for the same parts as those in FIGS. 1-2*c*, even though small differences may occur.

This fourth embodiment corresponds essentially to the third embodiment shown in FIG. 4, except for the structure of the piercer 11, which is not provided with a resilient collar. Thus, the piercer 11 of this fourth embodiment is a simple single-use piercer that cannot close the outlet of the container 2 once the closure 22 has been pierced.

FIGS. 6*a* and 6*b* shown in sectional views details of a fifth embodiment of a beverage dispensing assembly according to the invention. Again, the same reference numerals will be used for the same parts as those in FIGS. 1-2*c*, even though small differences may occur.

The piercer 11 has again been provided with a resilient collar 25 working as described above with reference to FIGS. 2*a*-2*c*. However, in this fifth embodiment the connection between the piercer 11 and the dispensing tube 10 has been altered. The outlet of the piercer 11 is aligned with a connection piece 27 placed in the base part 5 with the dispensing tube 10 being connected to the bottom of the abutment part of the base part 5. In this embodiment no dispensing tube is initially connected to the piercer 11, and the base part 5 is provided with a permanent dispensing tube 10 in communication with the dispensing tap. Alternatively a separate interchangeable dispensing tube can be connected to the connection piece 27. The communication between the interior of the collapsible beverage container 2 and the dispensing tap is thus established in an automated way when the container 2 with the base unit 3 is forced towards the base part 5.

The structure of the piercer 11 in the fourth and fifth embodiments is applicable with any sealing means between the base unit 3 and the base part 5. Thus, there may be provided sealing means at the outer wall 16 of the base unit and/or at the neck part of the container, i.e. at collar 23, even though only the outer sealing has been shown. Alternatively in the fifth embodiment of the invention, the sealing means can be provided between a flange 45 extending downward from collar 23 and the central elevation 21 or a part thereof.

FIGS. 7*a* and 7*b* show schematically a dispensing valve 30 for the dispensing assembly according to the invention. The dispensing valve 30 may optionally be provided at the free end of the dispensing tube 10.

The dispensing valve comprises:

- a cylindrical tube 31 with an inlet end adapted for frictional connection with a dispensing tube (not shown);
- a first collar 32 on the tube 31, which collar 32 is connected to an outlet end of the tube in axial extension thereof, and with a larger diameter;
- a cup-shaped tubular part 33 connected to the cylindrical tube 31 and extending essentially in axial extension thereof;
- taps 34 connecting the tubular cup-shaped part 33 and the cylindrical tube 31 with a tubular space arranged between the first collar 32 and the cup-shaped part 33;
- a second collar 35 in frictional and slideable engagement with the first collar 32;
- an internal abutment part 36 in the second collar 35 for closing the outlet end of the dispensing valve 30.

If the base unit 3 is provided with a dispensing tube 10 the dispensing valve 30 can be provided at the free end of the dispensing tube 10 and be initially located in the base unit 3 as an integrated aseptic unit.

The dispensing valve 30 is adapted for placement in a dispensing tap adapted to open and close the dispensing valve 30 by appropriate means (not shown) in engagement with the collars 32, 35 of the dispensing valve 30.

An advantage the dispensing valve 30 is that it can be easily manufactured, and in low cost materials, allowing the dispensing valve to be used as a single use part delivered with the beverage container and dispensing tube. A further advantage of this is thus that when the dispensing valve is placed in a dispensing tap as described the beverage content of the container need not come into contact with any reusable parts, that needs cleaning, and may infect the beverage.

The dispensing valve 30 as described above can be also be used in combination with other kinds of beverage dispensing systems, e.g. traditional draught beer devices or dispensing systems specialized for soft drinks, independent of the exact dispensing system.

As described above and shown in the Figures the container 2 is placed in an upright position with the outlet 9 facing downwards, i.e. towards the centre of gravity. Thus the container 2 can be emptied completely. The force of gravity will aid in the emptying the container 2, and the dispensing assembly 1 thus requires less pressure for completely emptying of the container 2 than other dispensing assemblies known in the art.

The base unit 3 comprises an outer wall 16, means for inseparably connecting the base unit 3 to the collapsible beverage container 2, closure means 22 for sealing the container 2 and a piercer 11 for piercing the closure 22 to provide access to the contents of the container 2. An annular space is provided which preferably holds the dispensing tube for connecting the outlet 9 of the container 2 with the dispensing tap 4. Preferably, the base unit 3 further comprises a seal (not shown) fixed to the lower edge of the outer wall 16. Additionally, before the base unit 3 is connected to a container it comprises a seal (not shown) fixed to the upper edge of the outer wall 16. These seals are applied upon manufacture of the base unit 3 to provide an aseptic unit that can be connected to a container 2 at a later stage. The aseptic unit is ready for use upon removal of the seals.

Thus, the base unit 3 can be easily manufactured as an aseptic unit in a central place and be transported to even remote beverage suppliers e.g. breweries or wineries. The beverage containers 2 can be transported separately to the site of filling. Usually such beverage containers 2 are not blown to their full size until immediately before their filling with beverage. At the production site the beverage containers 2 are blown to their full size, the container 2 having a body part with a generally cylindrical wall, a shoulder part and a neck part constituting an inlet and outlet 9. After blowing the container 2 into shape the container 2 is filled with the desired beverage and closed by pressing the base unit 3 over the neck, after removal of the upper seal. The seal on the bottom of the base unit remains in place.

The container 2 is preferably manufactured from plastics, particularly a polymer, such as PEN or PET. Thus, the container 2 can be formed as a thinwalled, self-supporting structure that is suitable for collapsing when an external pressure is applied in a dispensing assembly 1. The container 2 can be manufactured as a multilayer construction comprising an oxygen barrier for preserving the beverage content of the container. Furthermore, the container 2 can be tinted or died to create a barrier to light, in case the beverage quality is sensible to light. Such a light barrier could be placed in the oxygen barrier. Other suitable processes are coating the container 2, e.g. plasma coating the interior surface and/or epoxy-coating the exterior surface.

Preferably, the connection between the base unit 3 and the container 2 is of such a nature that once the base unit 3 has been secured to the container 2 it cannot be removed without damaging the container 2 and/or the base unit 3, thus providing a tamperproof container unit containing beverage ready to be delivered to the place of consumption. Such an inseparable connection can be obtained in a variety of ways. Preferably the connection is obtained by press fitting the base unit over the neck of the container 2, the neck and base unit 3 being provided with cooperating locking means, e.g. in the shape of taps/barbs and recesses/collars as indicated in the Figures or any other kind of snap mechanism. Alternatively, the base unit 3 can be glued or welded to the neck of the container 2, or the base unit 3 could be screwed onto the neck of the container 2, provided the thread is equipped with means for preventing release of the base unit 3.

Preferably, the press fitted base unit 3 connection with the neck of the container 2 is lined with a thin seal in the shape of an annular or circular membrane for providing a hermetic connection between the base unit 3 and the container 2. The membrane is preferably of the type used to line the inside of a metal cap of a traditional glass beer bottle.

Preferably, the base unit comprises:

- a preferably cylindrical outer wall 16;
- means for bearing against the shoulder of the collapsible beverage container 2 in the form of a wall;
- means for bearing against the neck of the collapsible beverage container 2 in the form of a wall;
- means for securing an inseparable connection of the base unit 3 press fit to the collapsible beverage container 2, in the form of three or more annular elevations, cooperating with an annular elevation on the neck of the container 2. The annular elevation can be replaced by corresponding circumferentially arranged recesses, taps or barbs;
- means for holding a dispensing tube 10 under sterile conditions during transport in the form of a space, where the dispensing tube can be rolled up (not shown);
- a closure 22 for sealing the outlet 9 of the collapsible beverage container 2 in the form of a wall;
- an indentation formed in the wall, weakening a part of the wall for allowing piercing by application of a predetermined force;
- means in the form of a collar or studs for abutting against an elevation of the base part for temporarily preventing that the base unit 3 is forced into the base part 5 with ensuing damage to the piercer 11;
- means for providing an airtight connection with the base part 5;
- means for holding the piercer 11, preferably in the form of a cylindrical support wall;
- a piercer 11 held in slideable relation to a support wall, along the axis of the cylindrical support wall; and
- protection means for protecting the piercer 11, and for providing support to the seal in the central area of the base unit 3, in the form of a wall or a set of walls surrounding the piercer 11 in order to protect the piercer 11 against unintentional impacts to the base unit 3 during handling.

In all embodiments the parts of the base unit 3 are preferably made in a plastics material such as PET or PE. This allows for low construction costs, and further allows the parts to be grinded and recycled for new plastics products, e.g. new base units 3. The seals can be glued to the base unit 3. The material for these seals can e.g. be a plastics, a plastics coated paper, paper, aluminium foil.

If it is desired to cool the beverage before dispensing it can be done in a variety of ways. With the present invention the pressurizing unit with the base unit 3 and the collapsible beverage container 2 can be utilized with known draught beer and soft drink dispensing assemblies where the beverage is cooled in a cooling unit on its way from the beverage container to the dispensing tap. Further there is the option of placing the entire pressurizing unit in a refrigerated environment, such as in a refrigerator. Another option is to apply a cold pressurizing fluid.

FIG. 8*a* shows a perspective view of an alternative base unit 3 for a beverage dispensing assembly and a method of dispensing a beverage from a collapsible container, according to the invention. FIGS. 8*b-c* and FIG. 8*d* shows sections through the alternative base unit 3 and a corresponding alternative base part 5, respectively. The same reference numerals will generally be used for the same parts as those in FIGS. 1-6*b*, even though small differences may occur. General features of the base unit 3 and the base part 5 in this embodiment are similar to the embodiments as described above. Thus the base unit 3 comprise a housing with an outer wall 16, means for attachment to the outlet end 9 of a collapsible container 2, and means for cooperating with a base part 5. The base part 5 comprise means for receiving and supporting the base unit 3 and a pressure fluid inlet 7 for pressurising a pressure chamber 8 provided between a collapsible container 2, the base unit 3, the base part 5 and a cover 6 of the dispensing unit.

In FIG. 8*a-c* the base unit 3 is shown without the collapsible container 2 attached, to allow a better view of the internal parts of the base unit 3. In this alternative embodiment the base unit 3 comprises a flexible cup-shaped part 40 covering the outlet portion 9 of the container 2, and in extension thereof. The cup-shaped part 40 is preferably arranged inside collar 23 as in the above described embodiments. The cup-shaped part 40 comprises a bottom 42, a side wall 43, and a hollow, elongate piercer 11 formed in the bottom 42 of the cup-shaped part 40. The downwardly extending part of said piercer 11 is preferably connected to one end of a length of dispensing tube 10. Preferably this tubing 10 is, at its other, free end equipped with a dispensing valve 30, e.g. as described above, for attaching to a dispensing tap 4. The upwardly extending end of the piercer 11 is adapted to pierce a closure 22 provided within the housing of the base unit 3. In this embodiment, preferably, the closure 22 is comprised by a separate seal sealingly arranged on and to an upper rim 41 of the preferably annular cup-shaped part 40. This seal/closure 22 is preferably formed by an air and fluid-tight metal or polymer foil that can e.g. be welded, glued or otherwise be sealed onto the base unit 3. The cup-shaped part 40 is formed having an inherent resiliency, or having resilient zones, preferably by forming the side wall 43 with a lesser material thickness than the surrounding parts of the base part 3.

In FIG. 8*d* a base part 5 corresponding to the base unit 3 in FIG. 8A is shown. The base part 5 comprises an abutment surface in the form of an upwardly facing surface on a central elevation 21 provided in the base part 5, said abutment surface being adapted for cooperation with the bottom part 42 of the cup-shaped part 40.

By pressing the bottom part 42 of the cup shaped part 40 against the abutment surface on the central elevation 21 the wall 42 will give in and flex, due to its inherent resiliency, causing the bottom 42 to move relative to the other parts of the base unit 3 in a direction toward the container 2, thus forcing the piercer 11 against and through the closure 22, whereby the closure 22 is pierced, and fluid access to the contents of the container 2 is provided.

In this embodiment the resiliency of the cup-shaped part 40 may be utilized in the same way as the taps 18 mentioned with the embodiments described above. The taps 18 and/or the cup-shaped part 40 will support the collapsible beverage container 2 prior to the piercing of the closure 22, and the inherent resiliency of these taps 18 and/or the cup-shaped part 40 may aid the removal of the container 2 with the base unit 3 in that the resiliency will push the container 2 upwards when the pressure in the pressure chamber 8 is relieved. Thus the resiliency of the cup-shaped part 40 can be adapted such that cup-shaped part 40 can be used instead of or in combination with the taps 18.

The base part 5 in this embodiment comprises sealing means, e.g. in the form of an O-ring 24 between an elevated annular platform 19 and the collar 23. Alternatively the sealing can be provided between elevated annular platform 19 and the side wall 42 of the cup-shaped part 40.

In all embodiments the flange 45 can be adapted for aiding the outer wall 16 in supporting the collapsible container 2 with the base unit 3 on the base part 5 during use/tapping.

As is the case with the above embodiments as described with FIGS. 2-5*b* flange 45 extending downward from the collar 23 and protecting the cup-shaped part 40 can be provided with one or more ports through which a dispensing tube (not shown) can be extended. The purpose of this flange 45 in any case is to protect the piercer 11 from accidental blows to during handling.

Although not shown in FIG. 8*d*, the base part 5 comprises an opening 26 for extending the dispensing tube 10 to the dispensing tap 4, as with the above described embodiments.

Preferably, the piercer 11 in this embodiment is positioned asymmetrically with relation to a central axis through the base unit 3 and base part 3 as can be appreciated from FIG. 8*c*. Thus, more room for manoeuvring the dispensing tube 10 is allowed within the space defined by the above mentioned flange 45. Also, the asymmetric position of the piercer 11 allows room the central elevation 21 on the base part 5, such that the abutment between the central elevation 21 and the bottom part 42 of the cup-shaped part 40 can occur.

Alternatively, the elevation 21 can be asymmetrically positioned, as opposed to centrally, and the piercer 11 can be then be centrally positioned. The asymmetrically positioned elevation 21 or piercer 11 can also be applied with the embodiments described above.

An extra, annular wall 46 may be provided in the interior of the base part. Thus an internal space 47 emerges. This space 47 can advantageously be utilized for containing a dispensing tube 10 and e.g. a dispensing valve 30 as described above.

The cup-shaped part 40, the piercer 11 and the annular wall 46 in this embodiment are preferably formed integrally with, and in the same material as the remaining parts of the base unit 3 except from the piercable seal/closure 22, e.g. in a moulding process. The base unit can be equipped with seals on the upper and/or lower periphery of the outer wall 16 as described above.

FIGS. 8*b-c* and 8*d*, respectively also show an alternative outer sealing between the base unit 3 and the base part 5. In addition to the sealing 24 provided between the elevated annular platform 19 and the collar 23, there may be provided outer sealing means, e.g. in the form of an O-ring 17 disposed on an outwardly facing sidewall of an additional elevation 50 of the base part 5. These sealing means 17 cooperates with the inwardly facing surface of the lower part of the outer wall 16 of the base unit 3, in order to provide a hermetical sealing as described above for the embodiments as illustrated with FIGS. 2-5*b*. However, in those embodiments the sealing means 17 were provided on the inner surface of the upwardly extending peripheral wall 13 of the base part 5, and adapted to cooperate with the outer surface of the lower part of the outer wall 16 of the base unit 3.

By a construction having the additional sealing means 17 on an additional elevation 50, the lower periphery of the wall 16 of the base unit 3 can be reinforced e.g. with a set radially extending ribs 48. Thus the sealing 17 is protected from deformations of the wall 16 caused by accidental blows to the base unit 3 that might occur during the handling of the collapsible container.

Further, more room is thus provided in the upwardly extending peripheral wall 13 of the base part 5 for forming a pressure fluid inlet 7 for the pressure chamber 8. The pressure fluid inlet 7 is not shown in FIG. 8*d*. It is obvious that this sealing feature would also apply to embodiments one through five described above In combination with this outer sealing 17 between inside of wall 16 and outside of elevation 50 one or more bypass channels 49 can advantageously be formed in the inner surface of the outer wall 16 of the base unit 3. Such bypass channels 49 allows the base part 5 and the base unit 3 according to this embodiment of the invention to be used as described above for the embodiment shown in FIGS. 2*a-c*. Thus the outer sealing 17 is only utilized during the compression of the cup shaped part 40 for piercing the closure 22. Upon the piercing, the pressure chamber 8 is now limited by the sealing 24 between the collar 23 and the elevated annular platform 19.

This is especially important if the pressure in the pressure chamber 8 is high. The container might be placed for tapping for elongated periods, e.g. two weeks. A continuous high pressure on the construction especially the outer wall 16 might weaken the construction. This is avoided by shifting the forces to the sealing 24 between the collar 23 and elevation 19 by utilizing the bypass channels 49. Thus, the base unit can be formed in a thinner, weaker and/or less costly material.

As with the previous embodiments the piercing can be accomplished without the outer sealing 17, e.g. by applying manual downward pressure on the container or by the inner sealing 24 between the collar 23 and the elevation 19 alone.

The reinforcing ribs 48 on the outer bottom periphery of wall 16 will also provide a stable stand of the beverage container. Such ribs 48 are preferably formed integral with the base part 3 in a moulding process.

The invention claimed is:

1. A method for dispensing a beverage from a collapsible container, which method comprises the steps of:

mounting a container unit on a substantially flat base part of a dispensing assembly, the container unit including a collapsible container, a base unit and an outlet seal, an outlet of the container unit facing downwardly from the container, the container unit and outlet configured to permit the beverage in the container to flow downwardly therefrom, said base unit and said base part being provided with sealing means for hermetically sealing the base unit to the base part;

arranging a free end of a dispensing tube at a closed dispensing tap located outside the dispensing assembly, the dispensing tube connected to a vertical hollow piercer that is aligned with the sealed outlet of the collapsible container;

mounting a cover on the base part in a hermetically sealed manner to form a pressure chamber between the collapsible container, the base unit, the base part and the cover;

piercing the sealed outlet of the collapsible container by the vertical hollow piercer arranged between the sealed outlet and the base part, thereby bringing the beverage in the collapsible container in communication with the dispensing tube;

providing an increased pressure in the pressure chamber;

opening the dispensing tap to dispense at least a part of the beverage through the dispensing tube to the environment by pressurizing the collapsible container and thereby reducing the volume thereof.

2. The method according to claim 1, wherein the container provided with the base unit is temporarily held separated from the base part by a resilient means until an increased downwards force is applied to the container whereby the container moves downwards causing the piercer to pierce the sealed outlet.

3. The method according to claim 2, wherein the increased downwards force is applied manually.

4. The method according to claim 2, wherein the increased downwards force is applied by the increased pressure in the pressure chamber.

5. The method according to claim 1, wherein the free end of the dispensing tube is maneuvered to the dispensing tap outside the dispensing assembly through an opening in the base part before the piercer pierces the sealed outlet.

6. The method according to claim 1, wherein a seal that aseptically seals the sealed outlet is removed before the container provided with the base unit is mounted on the base part.

7. A beverage dispensing assembly comprising:

a collapsible beverage container comprising:

a generally cylindrical collapsible wall part, an outlet end, and a neck part at the outlet end;

a pressurizing unit comprising:

means for connecting the pressurizing unit to a pressure media source, a substantially flat base part, and a cover, said base part and cover being sealingly interconnectable;

a base unit comprising a housing, a piercable closure for sealing the collapsible container, locking means for inseparably and hermetically connecting the base unit to the neck part of the collapsible container, and sealing means for hermetically sealing the collapsible container to the base part;

the base unit and collapsible beverage container mounted on the base part with the outlet of the container and facing downward, the container and outlet configured to permit the beverage in the container to flow downwardly therefrom;

a hollow piercer adapted for piercing the piercable closure;

a closable dispensing tube connected to the hollow piercer;

wherein the base unit and the neck part are provided at a lower end of the container, and that said housing of the base unit has an outer wall extending axially beyond said neck part in a downwards direction substantially in extension of the wall of the collapsible container, and said base part has a surface adapted for supporting said outer wall extension.

8. The beverage dispensing assembly according to claim 7, wherein the sealing means for hermetically sealing the collapsible container to the base part is provided between a collar on the base unit and the base part, said collar extending downwards from, and substantially in axial extension of, the neck part of the container.

9. The beverage dispensing assembly according to claim 1, wherein the sealing means for hermetically sealing the collapsible container to the base part is provided between the outer wall of the base unit and the base part.

10. The beverage dispensing assembly according to claim 7, wherein resilient support means are provided for temporarily spacing the container and base unit from the base part.

11. The beverage dispensing assembly according to claim 10, wherein the resilient support means are provided in the base unit extending axially downward therefrom.

12. The beverage dispensing assembly according to claim 7, wherein the hollow piercer aligned with the sealed outlet of the collapsible container is provided in the base unit.

13. The beverage dispensing assembly according to claim 12, wherein the hollow piercer has means for abutment on the base part, the base part having corresponding abutment means.

14. The beverage dispensing assembly according to claim 13, wherein resilient means are provided between the hollow piercer and the base unit, said resilient means providing means for closing the container if the container has to be removed from the base part.

15. The beverage dispensing assembly according to claim 7, wherein the hollow piercer aligned with the sealed outlet of the collapsible container is provided on the base part.

16. The beverage dispensing assembly according to claim 7, wherein the base unit comprises a resilient cup-shaped part said cup-shaped part comprising a side wall; a bottom adopted for cooperating with a central elevation on the base part; and a hollow piercer; and a closure formed on an upper rim of said cup-shaped part.

17. The beverage dispensing assembly according to claim 7, wherein the piercer is arranged asymmetrically with respect to a central axis through the base unit.

18. A beverage dispensing assembly according to claim 7, wherein the base unit has an annular space for accommodating the dispensing tube.

19. The beverage dispensing assembly according to claim 7, wherein a free end of the dispensing tube is provided with a dispensing valve.

20. A container unit adapted to a dispensing assembly according to claim 7 which container unit comprises a collapsible container and a base unit, wherein said base unit seals a downwardly facing neck part comprising an outlet of the collapsible container, the base unit comprising an outer wall extending axially beyond said neck part in a downwards direction substantially in extension of the wall of the collapsible container, and that a removable aseptic seal covering the outlet is provided.

21. The container unit according to claim 20, wherein the removable aseptic seal is connected to the outer wall at the bottom of the base unit.

22. A method for dispensing a beverage from a collapsible container, which method comprises:

mounting a container unit on a base part of a dispensing assembly, the container unit including a collapsible container, a base unit and an outlet seal, the collapsible container having an outlet facing downwards, the collapsible container and outlet configured to permit the beverage in the container to flow downwardly therefrom, the base unit hermetically sealed to the base part;

arranging a free end of a dispensing tube at a closed dispensing tap located outside the dispensing assembly, the dispensing tube being connected to a vertical hollow piercer that is aligned with the sealed outlet of the collapsible container;

mounting a cover on the base part in a hermetically sealed manner to form a pressure chamber between the collapsible container, the base unit, the base part and the cover;

piercing the sealed outlet of the collapsible container by the hollow piercer arranged between the sealed outlet and the base part, thereby bringing the beverage in the collapsible container in communication with the dispensing tube;

providing an increased pressure in the pressure chamber;

opening the dispensing tap to dispense at least a part of the beverage through the dispensing tube to the environment by pressurizing the collapsible container and thereby reducing the volume thereof.

23. A method according to claim 22, wherein the container provided with the base unit is temporarily held separated from the base part by one or more support elements until an increased downward force is applied to the container whereby the container moves downwards causing the piercer to pierce the sealed outlet.

24. A beverage dispensing assembly comprising:

a collapsible beverage container comprising:

a collapsible wall, an outlet end at the bottom of the container, and a neck part at the outlet end;

a pressurizing unit comprising:

a pressure fluid inlet configured to connect the pressurizing unit to a pressure media source, a substantially flat base part, and a cover, the base part and cover being sealingly interconnectable;

a base unit comprising a housing, a piercable closure for sealing the collapsible container, and a locking device for inseparably and hermetically connecting the base unit to the neck part of the collapsible container, the base unit and collapsible container mounted on the base part and sealing elements configured to provide a hermetic seal between the base unit and the base part, the outlet of the container facing downwards from the container when the container is mounted on the base part, the container and outlet configured to permit the beverage in the container to flow downwardly therefrom;

a hollow piercer adapted for piercing the piercable closure;

a closable dispensing tube connected to the hollow piercer;

wherein the base unit and the neck part are provided at the bottom of the container, the housing of the base unit having an outer wall extending axially beyond the neck part in a downwards direction substantially in extension of the wall of the collapsible container, and the base part having a surface adapted for supporting the outer wall extension.

25. The beverage dispensing assembly according to claim 24, wherein at least one resilient support element is provided between the hollow piercer and the base unit, the resilient support element configured for closing the container if the container has to be removed from the base part.

26. The beverage dispensing assembly according to claim 25, wherein the at least one resilient support element is provided in the base unit extending axially downward therefrom.

* * * * *